US005500508A

United States Patent [19]

Gerl

[11] Patent Number: 5,500,508

[45] Date of Patent: Mar. 19, 1996

[54] OVEN, PARTICULARLY WITH AN APPARATUS FOR PYROLTIC SELF CLEANING

[75] Inventor: Josef Gerl, Palling, Germany

[73] Assignee: Bosch-Siemens Hausgeraete GmbH, Munich, Germany

[21] Appl. No.: 153,299

[22] Filed: Nov. 16, 1993

[30] Foreign Application Priority Data

Nov. 16, 1992 [DE] Germany ..... 42 38 660.8

[51] Int. Cl.[6] ..... H05B 6/64; F24C 7/02

[52] U.S. Cl. ..... 219/400; 219/707; 219/681; 219/757; 126/21 A; 126/285 B

[58] Field of Search ..... 219/757, 400, 219/707, 681, 682, 683; 126/21 A, 21 R, 285 B

[56] References Cited

U.S. PATENT DOCUMENTS

| | | | |
|---|---|---|---|
| 3,678,245 | 7/1972 | Ackermann | 219/400 |
| 4,608,474 | 8/1986 | Kohka | 219/757 |
| 4,635,610 | 1/1987 | Nakanishi | 126/21 A |
| 4,839,486 | 6/1989 | Tanigawa | 219/757 |

FOREIGN PATENT DOCUMENTS

| | | | |
|---|---|---|---|
| 2621149 | 12/1977 | Germany . | |
| 3839657 | 5/1990 | Germany . | |
| 53-122950 | 10/1978 | Japan | 219/757 |
| 2-293528 | 12/1990 | Japan | 219/757 |
| 3-168525 | 7/1991 | Japan | 219/757 |
| 4-148114 | 5/1992 | Japan | 219/757 |

*Primary Examiner*—Philip H. Leung
*Attorney, Agent, or Firm*—Herbert L. Lerner; Laurence A. Greenberg

[57] ABSTRACT

An oven, particularly with an apparatus for pyrolytic self cleaning, includes an oven wall having an exhaust opening formed therein through which exhaust produced during oven operation can flow out to the outside. A throttle automatically adjusts an exhaust flow cross section of the exhaust opening or of a flow conduit adjoining the exhaust opening.

15 Claims, 1 Drawing Sheet

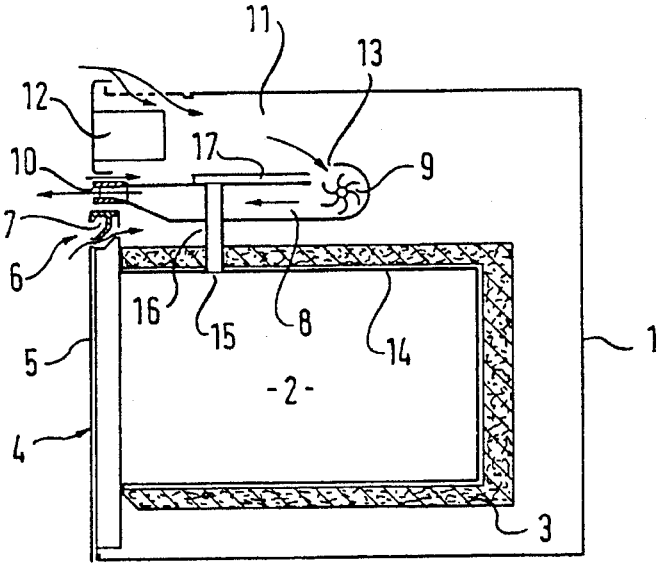
Fig. 1
Fig. 2
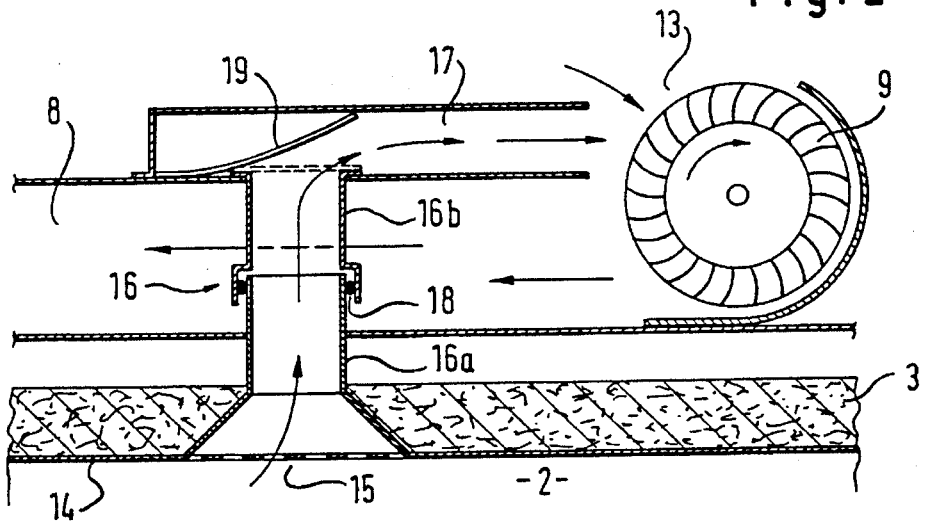
Fig. 3
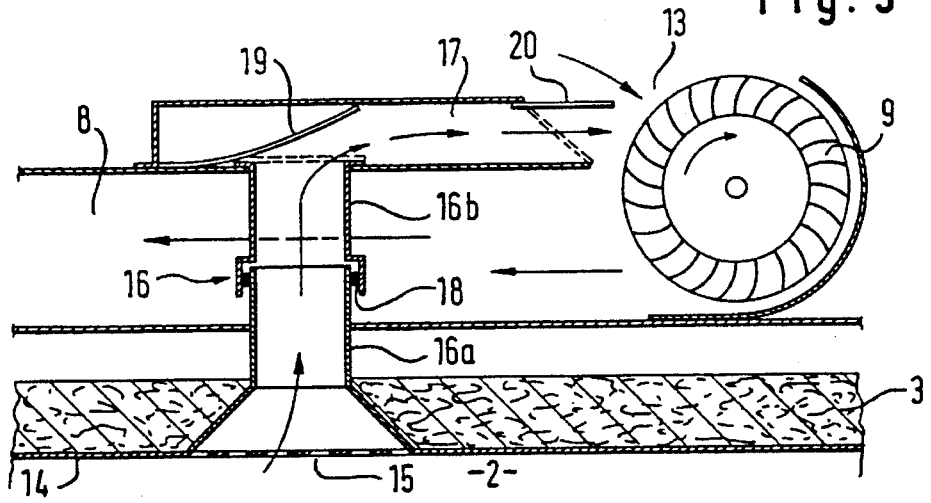

OVEN, PARTICULARLY WITH AN APPARATUS FOR PYROLTIC SELF CLEANING

BACKGROUND OF THE INVENTION

FIELD OF THE INVENTION

The invention relates to an oven, particularly with an apparatus for pyrolytic self cleaning, having an exhaust opening provided in an oven wall, through which exhaust or vapors produced during oven operation can flow out to the outside.

In a known microwave oven with a pyrolytic self-cleaning apparatus in an oven chamber, as in German Published, Non-Prosecuted Application DE-OS 26 21 149, a so-called catalyst is disposed in an upper oven wall and is adjoined by an air vent pipe having an end on which a throttle disk is provided. In that way a quantity of exhaust air to be aspirated by a blower through the catalyst and the air vent pipe during the self-cleaning mode is adjustable in adaptation to a pressure drop of the blower and to various structural conditions.

SUMMARY OF THE INVENTION

It is accordingly an object of the invention to provide an oven, particularly with an apparatus for pyrolytic self cleaning, which overcomes the disadvantages of the hereto-fore-known devices of this general type and in which it becomes possible to adapt the exhaust venting automatically to the particular operating mode of the oven.

With the foregoing and other objects in view there is provided, in accordance with the invention, an oven, comprising an oven wall having an exhaust opening formed therein through which exhaust produced during oven operation can flow out to the outside, and a throttle for automatically adjusting an exhaust flow cross section of the exhaust opening or of a flow conduit adjoining the exhaust opening.

The oven of the invention makes use of the recognition learned from the industry that in various baking cycles in the oven, or in the pyrolytic self-cleaning mode with an extremely high oven temperature, more or less large amounts of exhaust or vapor are produced. On one hand, in microwave operation of an oven that is only slightly warmed, for instance, an attempt is made to remove as much exhaust and therefore water vapor as possible by suction, so as to largely prevent problematic condensation of the exhaust, for instance on the window in the oven door. On the other hand, in the self-cleaning mode and in conditions of extremely pronounced heating of the oven, it is necessary to effectively cool the periphery of the oven, that is by means of a cooling air blower, in order to remove the heat escaping to the outside through the oven chamber wall but not the highly heated air (exhaust) acting to provide heat-cleaning in the interior of the oven. In both extreme cases, it is appropriate to operate the cooling air blower with high suction, although with different intended directions, in the first case in the direction out of the chamber of the oven in order to vent the exhaust, and in the second case in order to cool the surroundings of the oven.

In accordance with another feature of the invention, the exhaust venting is adapted to the various operating conditions by the throttle provided in the oven of the invention, which automatically adjusts as a function of the temperature and/or humidity of the exhaust flowing through the exhaust opening, in such a way that at a low oven temperature and a correspondingly low temperature of the exhaust, the flow cross section is as large as possible, while at a highly elevated temperature, for instance in the self-cleaning mode, the flow cross section is reduced or closed off.

In accordance with a further feature of the invention, the automatic adjustment is performed by using a bimetallic element as the throttle. On one hand, at a low oven operating temperature and with a correspondingly high content of water vapor in the exhaust, the widest possible opening of the flow cross section is promoted by the fact that the water vapor condenses on the relatively cool bimetallic element and therefore brings about an opening motion of the bimetallic element, due to the attendant cooling effect of evaporation.

On the other hand, at a high exhaust temperature, the proportion of water vapor drops, and therefore the aforementioned cooling effect does not occur, and a successive reduction in the flow cross section ensues.

In accordance with a concomitant feature of the invention, there is provided, in addition to the aforementioned throttle, a flap in the path of the exhaust flow conduit being likewise automatically adjustable as a function of the exhaust temperature and/or humidity, and likewise automatically changing the flow cross section of the flow conduit and toward the blower and in this way more or less widely opening the immediately adjacent suction opening of the cooling air blower for the removal of the air by suction, which, for instance, is markedly heated in the case of self cleaning, in the surroundings of the oven.

Other features which are considered as characteristic for the invention are set forth in the appended claims.

Although the invention is illustrated and described herein as embodied in an oven, particularly with an apparatus for pyrolytic self cleaning, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a diagrammatic, longitudinal-sectional view of an oven, with suggested means for venting exhaust; and FIGS. 2 and 3 are enlarged, fragmentary, longitudinal-sectional views of two different variants of the means for venting exhaust.

DESCRIPTION OF THE PREFERRED EMBODIMENTS

Referring now to the figures of the drawing in detail and first, particularly, to FIG. 1 thereof, there is seen an oven having an oven box or muffle 2 which is open at the front, which has an insulation 3 surrounding it and which is disposed inside an oven housing 1. The oven box 2 is closable by an oven door 4, which is bounded on the front by a glass pane 5. A door handle 6 with an indentation 7 is located at an upper boundary of the door 4. Disposed at a distance above the oven box 2 and its insulation 3 is a flow chute 8. The flow chute 8 has one end at which a motor-driven cooling air blower 9, such as a crossflow blower, is disposed, and another, front end which has a blower opening 10. Located above the flow chute 8 is a switch chamber 11 that accommodates an electronic control, an electronic clock 12, and the like. Arrows indicate the course of a flow of cooling air which is aspirated from the outside by the cooling air blower 9. This cooling air flows around the handle 6 and the switch chamber 11 and is carried away to the outside toward the front through the flow chute 8. The drawing does not show the means required for heating the interior of the oven box 2 and for heating material which is placed in it to be baked, such as electric heating elements, an ambient air blower, a microwave generator, or the like. These means are well known. As FIG. 1 also shows, an exhaust or vapor opening 15 is also provided in an upper oven wall 14, and a flow conduit 16/17 adjoins the exhaust opening 15. The flow conduit 16/17 includes a first, vertical conduit segment 16 that traverses the flow chute 8 and a second, horizontal conduit segment 17 which extends along the cooling air flow chute 8, where it is connected directly to an intake opening 13 of the cooling air blower 9.

As can be seen from the enlarged view in FIG. 2, the vertical conduit segment 16 includes two pipe connections **16*a* and 16*b* that can be put together and are sealed off from one another by means of a seal 18. The pipe connection 16*a* is widened in funnel-like fashion toward the exhaust opening 15 and is surrounded there by the insulation 3. Reference numeral 19 indicates a throttle that is constructed as a bimetallic element. The throttle 19 curves upward when the ambient temperature is low and therefore fully opens the upper outlet of the pipe connection 16*b* and thus the flow conduit 16/17. At a high ambient temperature, or if there is a flow of highly heated exhaust from the interior of the oven box 2 as is indicated by arrows, the throttle 19 automatically shifts to a closing position shown in dashed lines, in which the flow conduit 16/17 is at least largely closed. This closing position is attained at an oven box temperature, and therefore at a temperature of the outflowing exhaust, of approximately 350° C., or in other words at the beginning of a pyrolytic self-cleaning operation. Conversely, the maximum opening position of the throttle 19 is attained during operation of the oven at a low temperature, such as in microwave operation, or in other words in an operating mode in which is the exhaust is relatively cool but has a high water vapor content. Since the throttle 19 is located at a relatively cool point, is spaced apart from and is above the oven box 2, the water vapor will condense on the throttle 19, that is on the bimetallic element, and as a result of the attendant cooling action will promote an adjustment of the throttle 19** to the maximum opening position. If the exhaust temperature increases further, then a successive decrease in the flow cross section ensues.

The exemplary embodiment of FIG. 3 largely matches that of FIG. 2, but it additionally has a flap 20 on the blower end of the conduit segment 17, which once again closely communicates hydraulically with the intake opening 13 of the cooling air blower 9. The flap 20 is likewise constructed as a bimetallic element which forms an upper boundary wall of the flow conduit 16/17 at the end thereof facing toward the blower and determines the outflow cross section at that end as a function of its thermally dictated flexing. As is suggested in FIGS. 2 and 3, the free end of the flow conduit 16/17 adjoins the first third of the intake opening 13 of the cooling air blower 9, which is constructed as a crossflow blower. Particularly in the pyrolytic self-cleaning mode, it is desirable to not merely prevent removal by suction of the extremely highly heated air from the interior of the oven box 2. Instead the cooling air blower 9 is also intended to aspirate much of the likewise-heated air from the surroundings of the oven box 2 and carry it to the outside in the direction of the arrow through the flow chute 8. Since the position of the flap 20 varies as a function of the temperature and/or humidity at the flap 20, in the self-cleaning mode, for instance, the flap 20 will adjust to the position shown in dashed lines and thus will not only close the flow conduit 16, 17 more, but will also uncover practically the entire cross section of the intake opening 13, preferably in the first third, in which particularly pronounced suction is attained, in order to aspirate the ambient air and achieve maximum cooling action in the surroundings of the oven box 2.

I claim:

1. An oven, comprising an oven wall having an exhaust opening formed therein through which exhaust produced during oven operation can flow out to the outside, and a throttle located at the exhaust opening adjusting an exhaust flow cross section as a function of at least one parameter selected from the group consisting of temperature and humidity of the exhaust; said throttle being a bimetallic element enlarging the exhaust flow cross section in the event of a relatively low heat production in the oven and decreasing the exhaust flow cross section with increasing heat production in the oven.

2. The oven according to claim 1, wherein said cross section is a cross section of said exhaust opening.

3. The oven according to claim 1, including a flow conduit adjoining said exhaust opening, said cross section being a cross section of said flow conduit.

4. The oven according to claim 3, including a cooling air blower with an intake opening; said flow conduit including at least first and second conduit segments; said first conduit segment having an end at which said throttle is disposed; and said second conduit segment having a free end communicating hydraulically with said intake opening of said cooling air blower.

5. The oven according to claim 4, wherein said conduit segments are disposed at an angle to one another.

6. The oven according to claim 4, wherein said conduit segments are disposed perpendicular to one another.

7. The oven according to claim 4, including a cooling air flow chute communicating with said cooling air blower, said first conduit segment traversing said cooling air flow chute, and said second conduit segment being at least approximately perpendicular to said first conduit segment and extending along said cooling air flow chute.

8. The oven according to claim 3, including a cooling air blower with an intake opening; said flow conduit having a free end directly adjoining said intake opening of said cooling air blower.

9. The oven according to claim 8, wherein said free end of said flow conduit adjoins a first third of said intake opening.

10. The oven according to claim 8, wherein said free end of said flow conduit directly adjoining said intake opening of said cooling air blower has a boundary wall in the form of a flap being adjustable as a function of at least one parameter selected from the group consisting of temperature and humidity of the exhaust for automatically varying the flow cross section of said flow conduit adjoining said intake opening of said cooling air blower.

11. The oven according to claim 10, wherein said flap is constructed as a bimetallic element.

12. The oven according to claim 1, including a flow conduit being spaced apart from said oven wall and having an end, said throttle being disposed at said end of said flow conduit.

13. The oven according to claim 12, wherein said flow conduit is vertical.

14. The oven according to claim 5, including a cooling air blower, and a cooling air flow chute communicating with said cooling air blower, said flow conduit traversing said cooling air flow chute.

15. The oven according to claim 1, wherein said throttle is in a closing position at an outflowing exhaust temperature of approximately 350° C.

* * * * *